US010584557B2

(12) United States Patent
Roessler et al.

(10) Patent No.: US 10,584,557 B2
(45) Date of Patent: Mar. 10, 2020

(54) DEBRIS PREVENTING DOWNHOLE AIR LOCK DEVICE AND METHOD

(71) Applicant: GEODYNAMICS, INC., Millsap, TX (US)

(72) Inventors: Dennis Roessler, Ft. Worth, TX (US); Raymond Shaffer, Burleson, TX (US); Kevin George, Cleburne, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

(21) Appl. No.: 16/191,672

(22) Filed: Nov. 15, 2018

(65) Prior Publication Data

US 2020/0048987 A1 Feb. 13, 2020

Related U.S. Application Data

(60) Provisional application No. 62/716,518, filed on Aug. 9, 2018.

(51) Int. Cl.

| | |
|---|---|
| ***E21B 29/00*** | (2006.01) |
| ***E21B 33/12*** | (2006.01) |
| ***E21B 33/134*** | (2006.01) |
| ***E21B 34/06*** | (2006.01) |
| ***E21B 17/08*** | (2006.01) |
| ***E21B 34/10*** | (2006.01) |

(52) U.S. Cl.

CPC ..... *E21B 34/063* (2013.01); *E21B 17/08* (2013.01); *E21B 29/00* (2013.01); *E21B 34/103* (2013.01)

(58) Field of Classification Search

CPC ..... E21B 34/063; E21B 29/00; E21B 33/12; E21B 33/134

See application file for complete search history.

(56) References Cited

U.S. PATENT DOCUMENTS

| | | | | |
|---|---|---|---|---|
| 2,149,659 | A * | 3/1939 | Rettis | E21B 34/063 137/68.27 |
| 3,779,263 | A * | 12/1973 | Edwards | E21B 34/063 137/68.25 |
| 5,947,204 | A * | 9/1999 | Barton | E21B 33/1295 166/317 |
| 6,334,488 | B1 | 1/2002 | Freiheit | |
| 9,382,778 | B2 | 7/2016 | Frazier | |
| 9,593,542 | B2 | 3/2017 | Getzlaf et al. | |
| 2011/0284242 | A1 | 11/2011 | Frazier | |

(Continued)

OTHER PUBLICATIONS

Halliburton, "What Happens When Compatibility Meets Reliability", Unconventional Completions, Frac Sleeve Systems, RapidStart Initiator CT Sleeve, BACE Tool.

(Continued)

*Primary Examiner* — Cathleen R Hutchins

(74) *Attorney, Agent, or Firm* — Patent Portfolio Builders PLLC

(57) ABSTRACT

An air lock device for sealing a casing located inside a well, the air lock device including a body having a bore and configured to be attached with each end to the casing; a moving element located inside the bore; and a blocking element connected to the moving element, the blocking element preventing a fluid to pass through the bore of the body. The moving element forms an inner chamber with the body in which the blocking element is trapped after the blocking element is punctured by the moving element.

22 Claims, 12 Drawing Sheets

(56) References Cited

U.S. PATENT DOCUMENTS

| | | | |
|---|---|---|---|
| 2014/0216756 | A1 | 8/2014 | Getzlaf et al. |
| 2017/0022783 | A1 | 1/2017 | Yong et al. |
| 2017/0096875 | A1 | 4/2017 | Ravensbergen et al. |
| 2017/0138153 | A1 | 5/2017 | Getzlaf et al. |

OTHER PUBLICATIONS

International Search Report and Written Opinion, dated Jan. 25, 2019, from corresponding/related International Application No. PCT/US2018/61199 (U.S. Publication Nos. 2014/0216756 and 2017/0096875 previously made of record on Nov. 15, 2018).

* cited by examiner

DEBRIS PREVENTING DOWNHOLE AIR LOCK DEVICE AND METHOD

BACKGROUND

Technical Field

Embodiments of the subject matter disclosed herein generally relate to downhole tools for deploying a casing into a wellbore, and more specifically, to an air lock device that is capable of controlling when a fluid passes through, without generating debris.

Discussion of the Background

In the oil and gas field, once a well 100 is drilled to a desired depth H relative to the surface 110, as illustrated in FIG. 1, a casing 102 for protecting the wellbore 104 needs to be installed and cemented in place. This operation involves lowering the casing 102 into the wellbore 104. A float collar 106 attached to a tip of the casing 102, is pushed to the toe region 108 of the wellbore 104. Then, cement is pumped through the casing 102 and the float collar 106 to fill an annulus 112 formed between the outside of the casing 102 and the inside of the wellbore 104. The float collar 106 ensures that no fluid from the well enters inside the casing during this process and also that the cement pumped through the casing can exit into the wellbore.

However, to deploy the casing 102 so that the float collar 106 reaches its final destination is not an easy task. The casing 102 weights thousands of kilograms, the space 112 between the casing 102 and the wellbore 104 is small (between 1 and 2 inches) and the friction between the casing and the wellbore is large. Note that FIG. 1 shows that the distal portion 102A of the casing is in direct contact with the toe region 108 of the wellbore, which means that a lot of friction is present between the casing and the well.

When the casing is lowered into the well, an air lock device 130 is typically inserted in the casing 102, as shown in FIG. 1 and this device is configured to separate the upper part 103 of the casing from the lower part 105. The upper part 103 is typically considered to be the vertical part of the casing while the lower part 105 is the horizontal part. Air is confined in the lower part 105 of the casing 102 to provide some buoyancy to the casing. In this way, the friction force between the casing and the wellbore is reduced, and the casing can be pushed with less force toward its final position. In addition, the upper part 103 is filled with the mud pumped by the pump 120, so that the vertical part is heavier, which also helps in pushing the horizontal part of the casing toward its final destination. The air lock devices provides a barrier between the air and fluid in the casing.

After the casing is placed at its intended final position, fluid communication needs to be established between the lower part 105 and the upper part 103 of the casing 102. The traditional air lock device 130 is built with a breakable disk 132, which prevents the fluid communication between the upper and lower parts. Thus, when this communication is desired to be established, a pressure of the fluid 107 is increased over a rated pressure of the breakable disk 132, and the disk breaks, thus opening a communication passage between the upper and lower parts of the casing.

However, a common problem of these air lock devices is that the breakable disk 132 is made from glass or ceramic to hold the pressure. The debris from rupturing causes problems as the debris interferes with the float collar 106. A partial solution to this problem is to install a filter 134, downstream the air lock device and upstream the float collar, as shown in FIG. 1. However, this solution has limited success as either the filter plugs up, or the filter allows too much debris through. In addition, the addition of the filter complicates the installation of the casing in the field and also the filter and the debris would need to be recovered at a later stage. Thus, there is a need for an air lock device that does not generate debris that interferes with the float collar or other downstream equipment.

SUMMARY

According to an embodiment, there is an air lock device for sealing a casing located inside a well. The air lock device includes a body having a bore and configured to be attached with each end to the casing, a moving element located inside the bore, and a blocking element connected to the moving element, the blocking element preventing a fluid to pass through the bore of the body. The moving element forms an inner chamber with the body in which the blocking element is trapped after the blocking element is punctured by the moving element.

According to another embodiment, there is a method for opening an air lock device in a casing located in a well, the method including lowering the air lock device and the casing into the well, wherein the air lock device is inserted between an upper part and a lower part of the casing; pumping a fluid into the upper part of the casing to further lower the casing into the well, wherein a blocking element located inside the air lock device prevents the fluid to pass through a bore of a body of the air lock device; increasing a pressure in the upper part of the casing to break a burst disk located in the body of the air lock device, the burst disk covering a passage between the bore and a moving element located inside the air lock device; puncturing the blocking element of the air lock device; and trapping the sheared blocking element inside a chamber formed between the moving element and the body.

According to yet another embodiment, there is an assembly to be placed inside an air lock device for preventing a fluid from passing through the air lock device, the assembly including a piston and a dome attached to the piston. The piston has a cutting element that rests against the dome and is configured to shear the dome open.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a casing that is deployed inside a wellbore for protecting the wellbore. However, the embodiments discussed herein are applicable to other casings, for example, production casings, that are deployed inside the previous casing for extracting the oil from the well.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, an air lock device is inserted between two parts of a casing and includes a blocking element and a moving element. The blocking element is configured to act as a barrier and separate an upper part of the casing, which holds a fluid, from a lower part of the casing, which holds air. The moving element is configured to move, when a pressure inside the casing is larger than a given threshold. The movement of the moving element makes the blocking element to open up, thus allowing communication between the upper part and the lower part of the casing. After the blocking element opens up, the moving element traps the blocking element inside of an annulus formed between the moving element and the casing, thus preventing debris from the blocking element from moving though the casing, toward a float collar. Various implementations of this novel air lock device are now discussed with regard to the figures.

Figure 1:
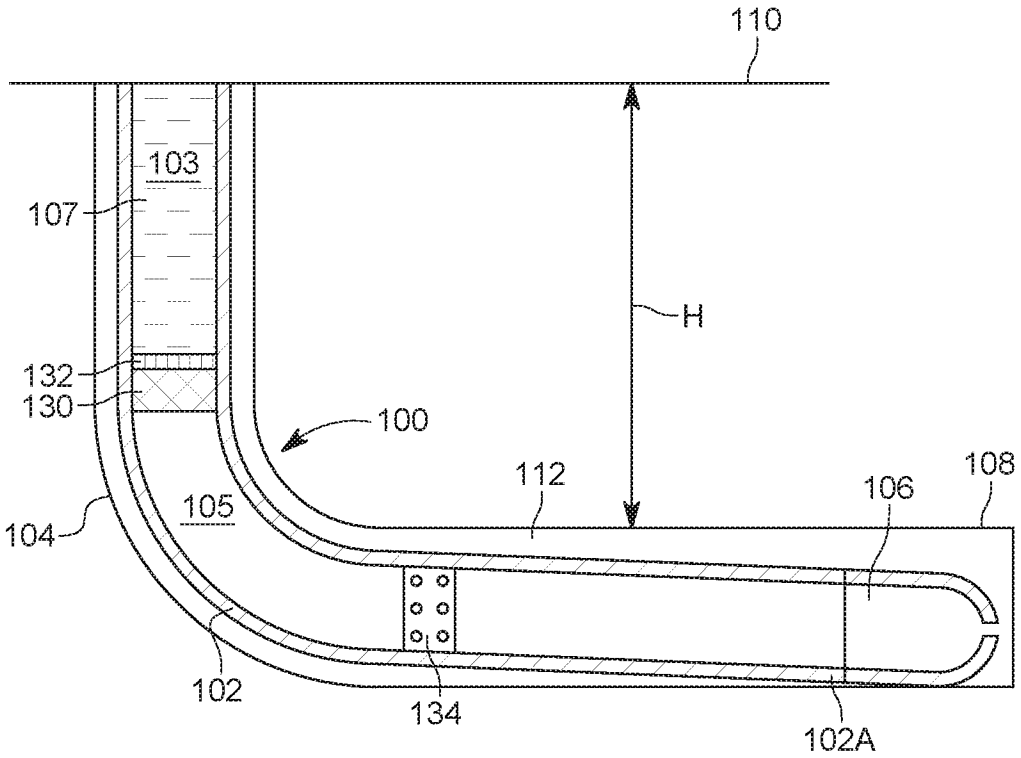
FIG. 1 illustrates a well and associated equipment for deploying a casing into the well.
Figure 2:
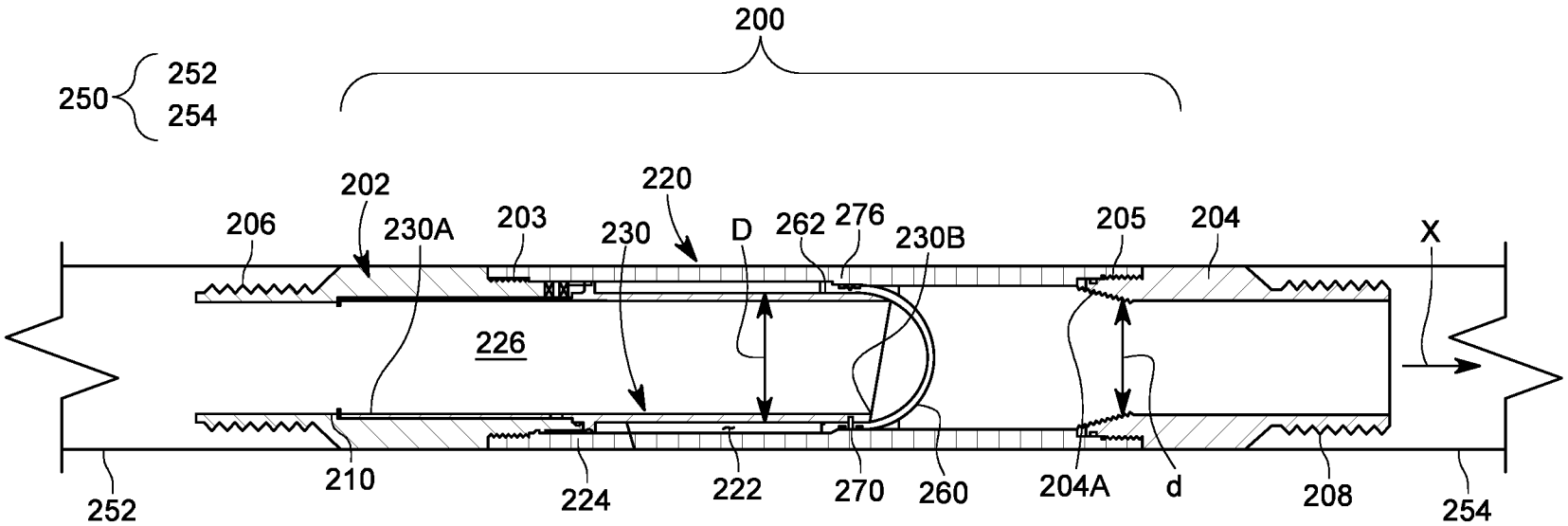
FIG. 2 illustrates a novel air lock device connected to a casing.

According to the embodiment illustrated in FIG. 2, an air lock device 200 includes an upper body 202, a lower body 204, and a central body 220. The upper body 202 is attached with threads 203 to the central body 220 and the lower body 204 is also attached with threads 205 to the central body 220. The upper and lower bodies may be attached by other means (e.g., pins) to the central body. In one embodiment, the three bodies are made as an integral piece. Regarding the terms "upper" and "lower," these terms are to be understood with reference to the head and toe of the well. The head of the well is at the Earth surface while the toe of the well is underground. For any object placed in the well, one part is closer to the head of the well, and thus, that part is referred to as an "upper" or "upstream" part. Based on the same logic, if a part of an object placed in the well is closer to the toe of the well, that part is referred to as a "lower" or "downstream" part.

Figure 3:
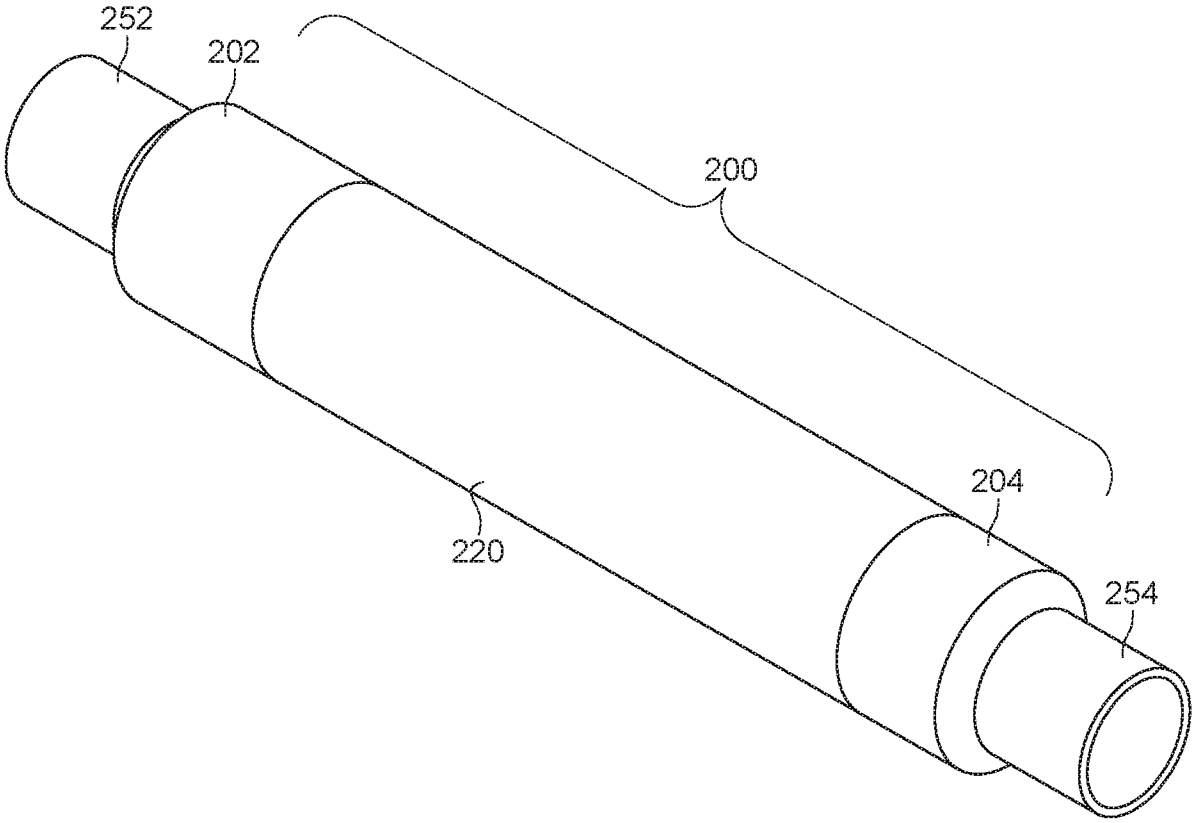
FIG. 3 is a perspective view of the novel air lock device.

The upper body 202 is configured to be attached to an upper part 252 of the casing 250 and the lower body 204 is configured to be attached to a lower part 254 of the casing 250. In one embodiment, as illustrated in FIG. 2, threads 206 are used to attach the upper body 202 of the air lock device to the upper part 252 of the casing, and similar threads 208 are used to attach the lower body 204 of the air lock device to the lower part 254 of the casing. The location of the air lock device along the casing 250 is calculated so that the final position of the air lock device in the well coincides, approximately, with the region where the casing changes its orientation from vertical to horizontal. In other words, when the casing arrives at its intended final location, the air lock device sits in the heel of the casing. FIG. 3 shows a perspective view of the air lock device 220 when integrated into the casing 250.

Returning to FIG. 2, the central body 220 has an inner chamber 222 formed between a wall 224 of the central body and a moving element 230. This chamber 222 is in essence the annulus formed between the moving element 230 and the central body 220. The moving element in this embodiment is implemented as a piston. The inner chamber 222 is filled initially with air. The inner piston 230 extends along the bore 226 of the central body 220, having a first (upper) end 230A that is facing the upper body 202 and a second end 230B that is facing the lower body 204. In its initial position, the inner piston 230 is positioned so that its first end 230A is located within the upper body 202, and the second end 230B is located within the central body 220. The piston 230 may be made of any material (for example, metal, composite, plastic, etc) and is configured to slide along a longitudinal direction X within the bore 226, until reaching an upper face 204A of the lower body 204. Upper face 204A is slanted relative to the longitudinal direction X and is made to have a diameter d smaller than an outer diameter D of the piston 230. In this way, the movement of the piston 230, when initiated along the longitudinal axis X, is stopped by the upper face 204A. A shoulder 210 formed within the upper body 202 is configured to stop the movement of the piston 230 in the opposite direction. Note that the shoulder 210 is made flush with the internal surface of the piston 230 for reasons discussed later.

Figure 4:
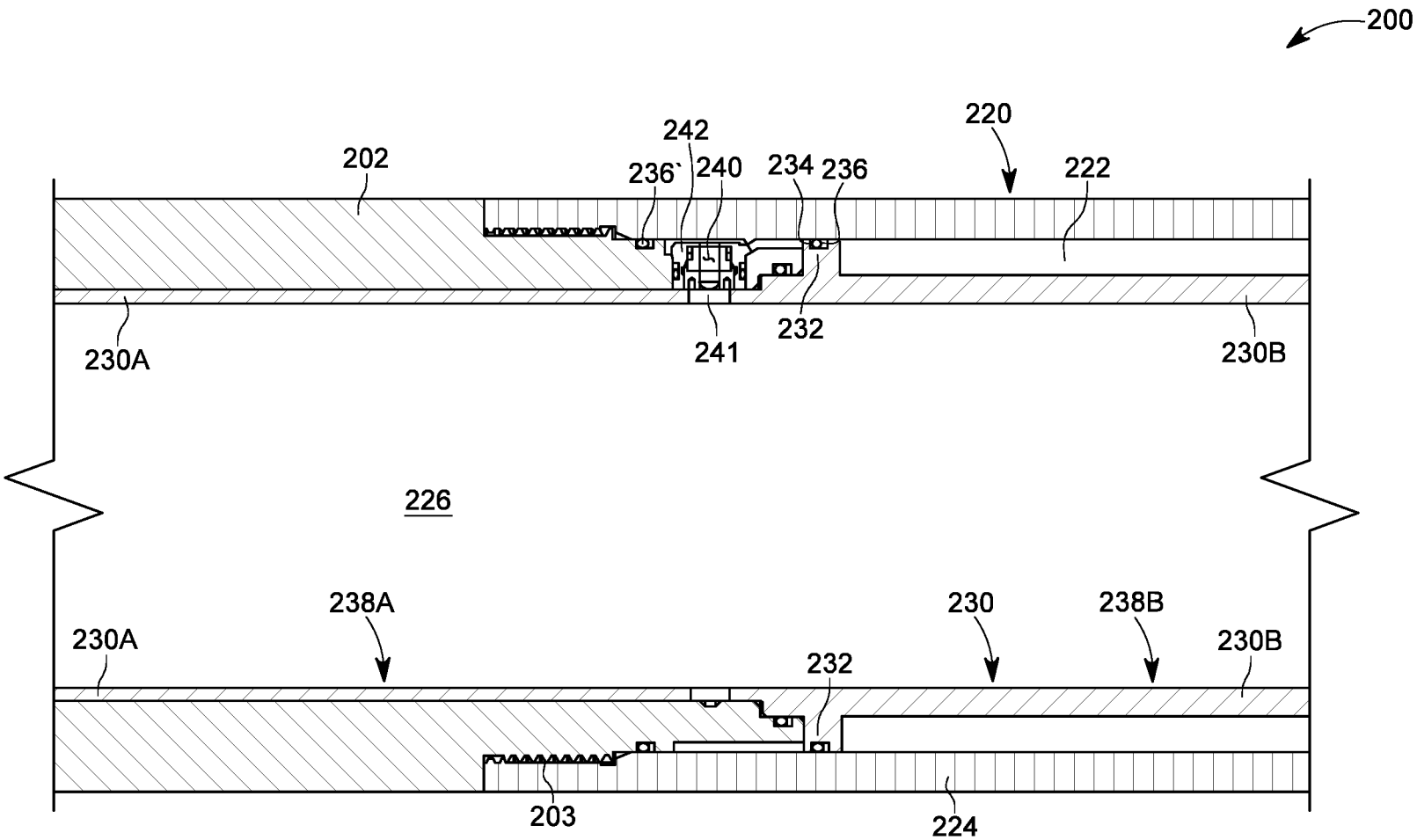
FIG. 4 shows details of a moving element of the air lock device.
Figure 5:
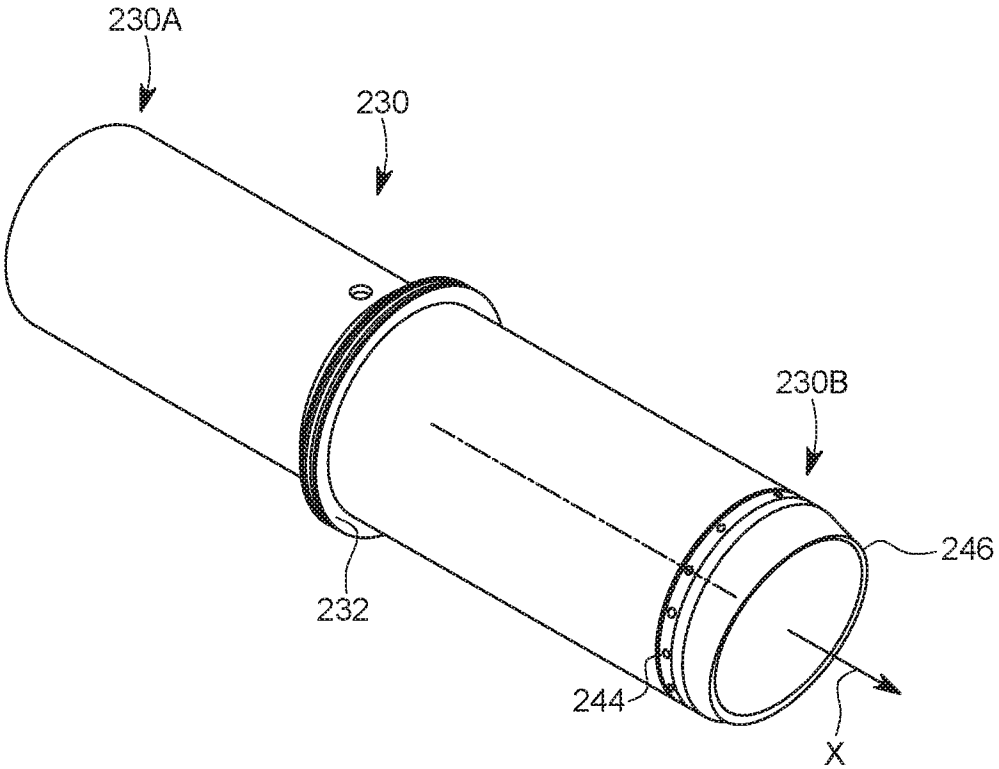
FIG. 5 is a perspective view of the moving element.

FIG. 4 shows in more detail the piston 230 and its placement relative to the wall 224 of the central body 220. The piston 230 has a shoulder 232 that directly contacts the wall 224 of the central body 220. The shoulder 232 extends all the way around the exterior circumference of the piston 230, as illustrated in FIG. 5. FIG. 5 also shows that the second end 230B (or lower end or downstream end) has one or more holes 244 formed around an external circumference. The piston 230 ends with a cutting element 246, which may be an angled end. In this case the piston may be a knife piston, i.e., a piston that has one end sharp and/or angled as a knife for cutting. Returning to FIG. 4, a groove 234 is formed in the shoulder 232 and an O-ring 236 is placed inside the groove 234 to prevent a fluid passing between the shoulder 232 and the wall 224 of the central body 220. Another O-ring 236' may be placed between the wall 224 of the central body 220 and the upper body 202 as shown in FIG. 4, for preventing a fluid to escape through the interface between the central and upper bodies. FIG. 4 also shows a burst disk 240 placed in a holder 242, where the holder 242 is located within a wall of the upper body 202. A hole 241 is formed into the wall of the piston 230 and this hole is aligned with the burst disk 240, so that a pressure from the bore 226 directly acts on the burst disk 240.

The piston 230 has an upper part 238A that extends from the shoulder 232 all the way to the first end 230A and a lower part 238B that extends from the shoulder 232 all the way to the second end 230B. While the upper part 238A is in direct contact with the central body 202, i.e., no chamber is formed between the upper part 238A of the piston and the interior surface of the central body 202, the lower part 238B of the piston defines together with the wall 224 of the central body 220 the interior chamber 222. This is the chamber where the blocking part previously discussed would be "stored" or trapped after being opened, as discussed later.

Figure 6:
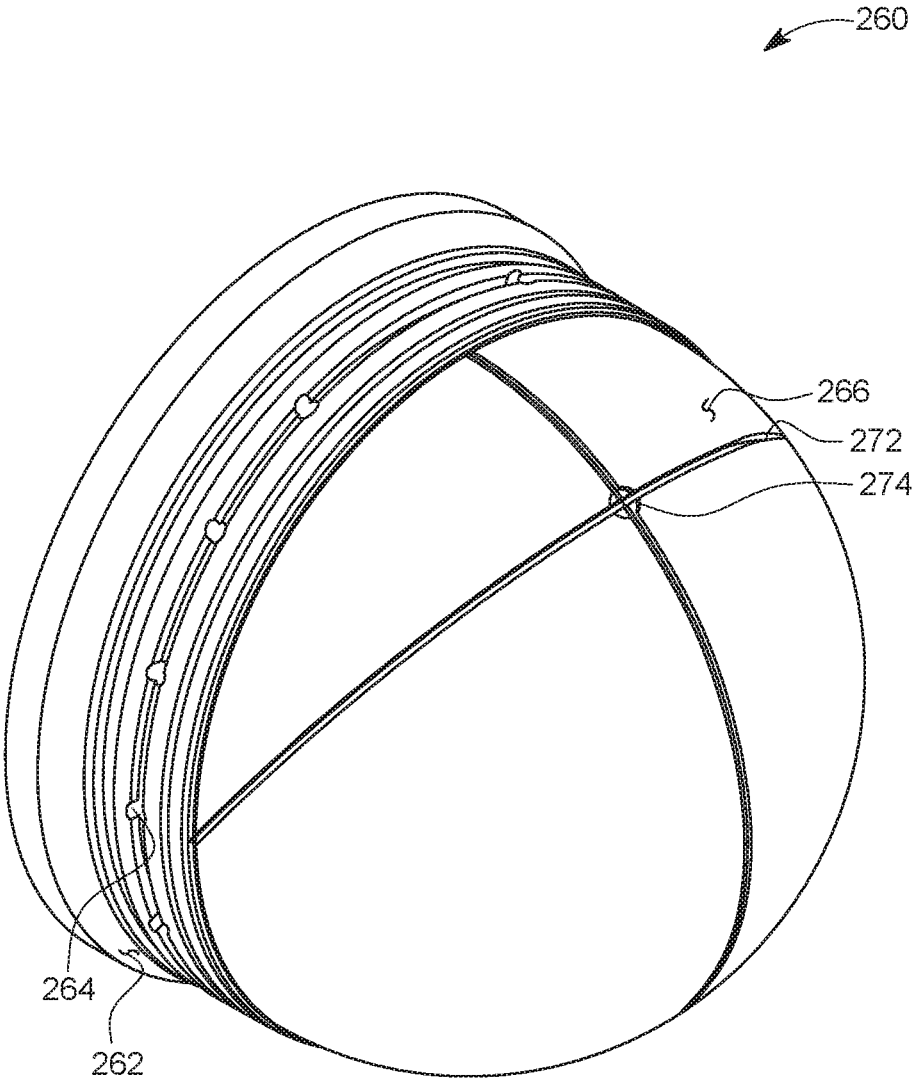
FIG. 6 shows details of a blocking element of the air lock device.
Figure 7:
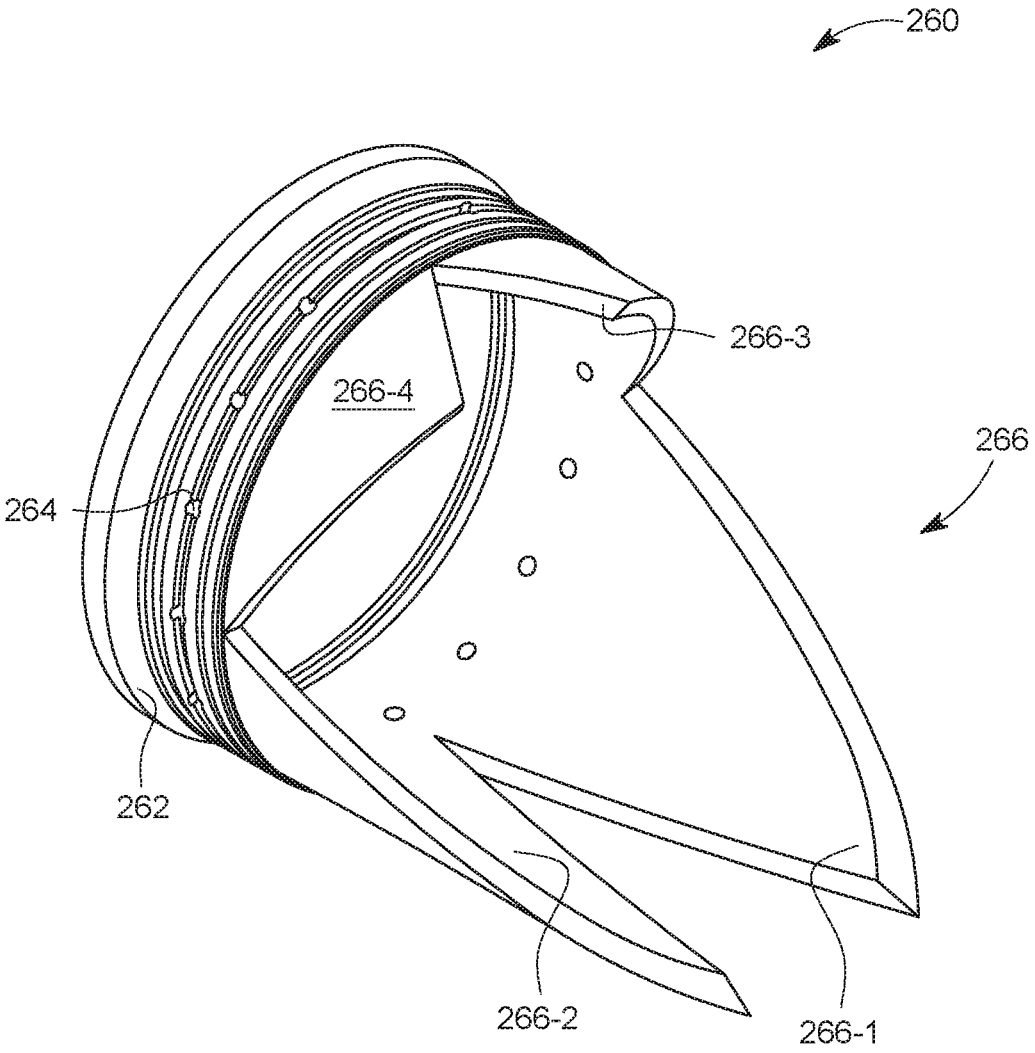
FIG. 7 illustrates the blocking element after being sheared by the moving element.

Returning to FIG. 2, a blocking member 260 is attached to the second end 230B of the piston 230. While the second end 230B is shown in the figures as being the lower end of the piston 230, in one embodiment, the entire air lock device 200 may be reversed so that the second end 230B becomes the upper end of the piston and the blocking member 260 is attached at the upstream end of the air lock device. For this embodiment, a flow back of the well activates the piston 230 so that the blocking member is ruptured in an upward direction. In one embodiment, the blocking member 260 is a dome as illustrated in FIG. 6. The dome 260 has a shoulder 262 that has plural holes 264. These plural holes 264 are configured to mate with the holes 244 formed in the lower end of the piston 230 so that the dome 260 can be fixedly attached to the lower end 230B of the piston. In this regard, FIG. 2 shows shear pins 270 being inserted in the holes 244 of the piston and the holes 264 of the dome for securing the dome to the piston. The shoulder 262 of the dome 260 fits over the lower end 230B of the piston 230. The dome 260 also has a top surface 266. The top surface 266 and the shoulder 262 may be made of the same or different materials. In one application, the shoulder and the top surface are made as two different pieces that are configured to be attached to each other. In another application, the shoulder and the top surface are made integrally as one element. The shoulder is made in such a way to withstand a high pressure, for example, in the range of 10,000 to 30,000 psi for reasons to be explained later. The top surface may be made to resist to the same pressure range. The top surface may be made to be flat or curved. FIG. 6 shows an embodiment in which the top surface is made curved, i.e., it has a dome shape. The top surface may be made of a material that can be cut or punctured so that when this event happens, the top surface does not shatter into many independent pieces, as in the traditional air lock devices. The material of the top surface is so chosen than when its structure is altered (i.e., is being cut or punctured or pierced or stabbed or perforated or penetrated) by the piston 230, the top surface opens up (or flowers) as illustrated in FIG. 7. Note that this figure shows the top surface 266 being cut into plural pieces 266-1 to 266-4, but none of these pieces are independent from each other, which means that they cannot flow down the casing freely. All these pieces (or most of them as accidentally, one or more may detach from the blocking member 260) remain attached to the shoulder 262. In one embodiment, such a material for the top surface 260 can be described as a shearable material that does not break into independent pieces. For example, an example of such a material is rubber. Other materials (for example composite materials) may be used.

To promote the bursting of the dome 260 when punctured by the piston 230, as illustrated in FIG. 6, the top surface 266 may be configured to have one or more grooves 272. These grooves have a lower resistance to cutting than the other parts of the top surface and thus, when the knife piston impinges on the top surface, these grooves would shear first, so that the entire top surface breaks along the grooves and all the cut pieces stay attached to the shoulder 262, as illustrated in FIG. 7. Further, to promote even more the bursting of the dome along the grooves 272, one or more counterbores 274 may be formed in the top surface. A counterbore is a weak point made in the top surface for promoting shearing. In one application, at least one groove 272 is positioned in the top surface so that the cutting edge of the cutting element 246 of the piston 230 matches its profile, i.e., the cutting element 246 would cut the top surface 266 exactly at the groove 272.

Figure 8:
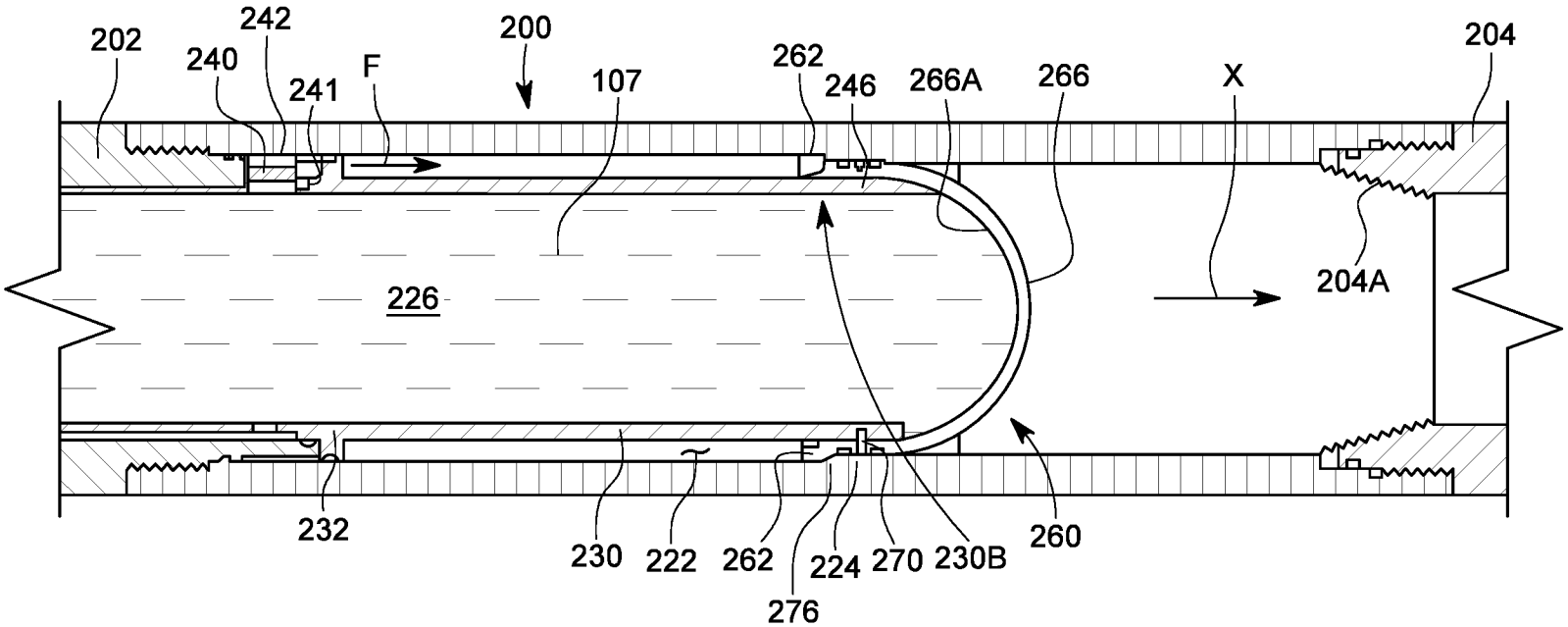
FIG. 8 illustrates the blocking element being attached to the moving element.

The attachment of the blocking element 260 to the piston 230 and the interior of the central body 220 is now discussed with regard to FIGS. 2 and 8. Both figures show a shoulder 276 formed in the inner part of the wall 224 of the central body 220. This shoulder is manufactured to mate with shoulder 262 formed in the blocking element 260. Also, as previously discussed, the blocking element 260 is attached with shear pins 270 to the external circumference of the lower end 230B of the piston 230. Note that FIG. 8 shows the cutting element 246 extending past the positions of the shear pins 270, and being adjacent to the interior surface 266A of the top surface 266 of the breaking element 260.

With this arrangement, when the air lock device is deployed, and the fluid 107 is pressing on the top surface 266 of the breaking element 260, neither the piston 230 nor the breaking element 260 are sliding along the longitudinal direction X. This is so because the shoulder 276 in the central body 220 blocks a movement of the shoulder 262 of the blocking element 260, and thus, the top surface 266 stays in place and is capable of blocking the fluid 107 from moving past the air lock device. In addition, the piston 230 does not move because there is no pressure acting on its surfaces along the longitudinal direction X as the interior surface of the piston is flush with the interior surface of the upper body 202, as previously discussed and as illustrated in FIG. 2. In addition, even if there is a small pressure acting on the piston 230 that would move the piston along the longitudinal direction X, because the piston 230 is attached with shear pins 270 to the shoulder 262 of the breaking element 260, the piston 230 remains in a rest position with the breaking element 260. Because the shoulder 262 is sandwiched directly between the piston 230 and the central body 220 (more precisely, the shoulder 276), and because of the shear pins 270, the shoulder 262 cannot slip past the shoulder 276.

However, this equilibrium state of the piston 230 and the breaking element 260 can change to a cutting state when the pressure of the fluid 107 is increased over a rated pressure of the burst disk 240, also shown in FIG. 8. Thus, if the pressure in the casing is increased by the pump at the head of the well, over the rated pressure of the burst disk 240, the disk 240 breaks and it will allow the high pressure inside the bore 226 to enter through a passage 241 formed in the holder 242 of the disk 240, and act on the shoulder 232 of the piston 230. At this instant, a longitudinal force F is exerted on the piston 230, which is pushing the cutting element 246 toward the interior surface 266A of the top surface 266. When the pressure inside the bore 226 is above the rated pressure of the disk 240, the force on the piston is high enough to shear the shear pins 270 and to cut through the top surface 266 of the blocking member 260. This means that the top surface 266 is cut into pieces, as illustrated in FIG. 7, and the piston 230 is now moving along the longitudinal direction X, toward the upper face 204A of the lower body 204 (see FIG. 8).

Figure 9:
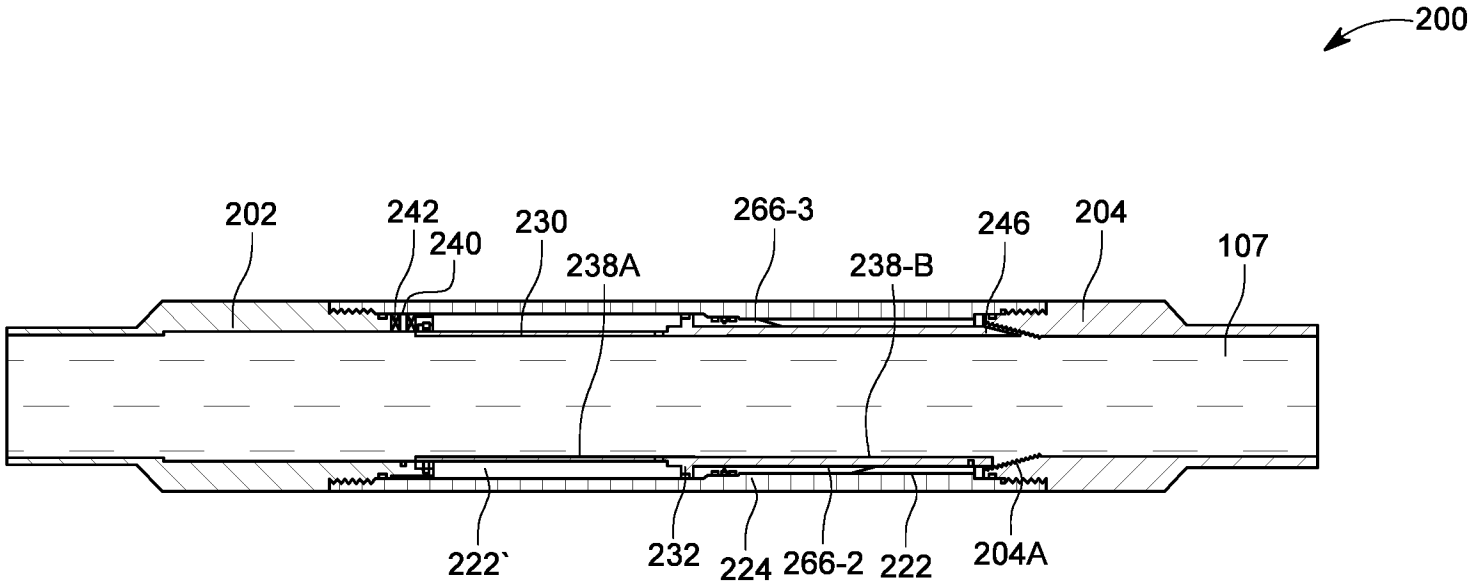
FIG. 9 illustrates the moving element after shearing the blocking element and moving to trap the blocking element.

The air lock device now enters a moving stage in which the piston 230 moves toward the upper face 204A of the lower body 204. During this process, as illustrated in FIG. 9, the piston 230 traps the various parts 266-1 to 266-4 of the top surface 266 inside the chamber 222, that is still present between the outside surface of the lower part 238B of the piston 230 and the inner surface of the wall 224 of the central body 220. A second chamber 222' is now formed between the upper part 238A of the piston 230 and the inner surface of the wall 224 of the central 220. The movement of the piston 230 stops when the cutting element 246 contacts the upper face 204A of the lower body 204 as the outer diameter of the cutting element 246 is larger than the inner diameter of the upper face 204A, as discussed with regard to FIG. 2. At this time, the piston comes to rest, the blocking element has been opened up and thus, the fluid 107 is free to move all the way to the toe of the well.

Advantageous relative to the traditional devices, there is no debris produced by the blocking element 260 as the blocking element is not designed to break into plural independent pieces that can travel along the bore of the casing. To the contrary, the blocking element 260 in this embodiment is designed to shear in plural parts, that remain attached to each other and in addition, these parts are then trapped inside a chamber formed by the piston 230 and the wall of the casing. Even if one or more small bits of the top surface 266 accidentally detach from the blocking element 260, the amount of debris generated by the air lock device 200 is insignificant comparative to the existing air lock devices. In addition, for this device, there is no need for a debris trap as required by the existing devices, which further simplifies the deploying procedure.

Figure 10:
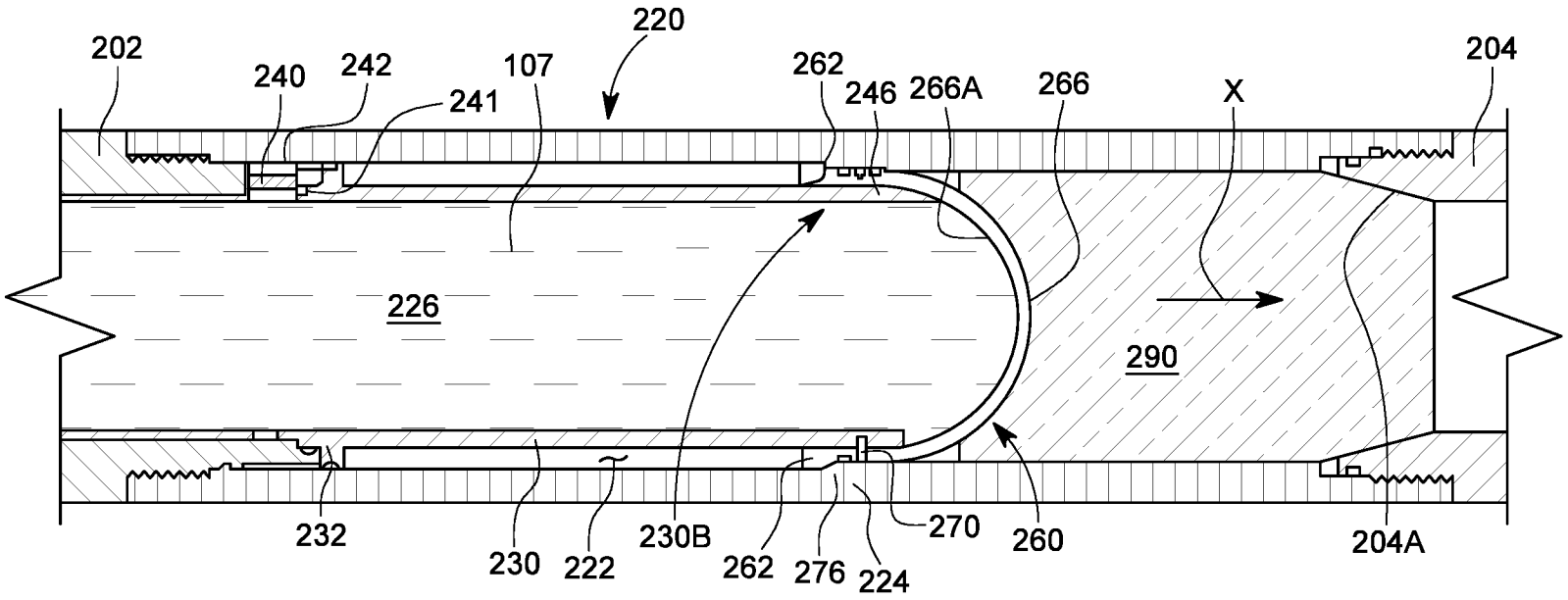
FIG. 10 illustrates a dampener added to slow down a movement of the moving element.

If the piston 230 moves too fast during the moving stage, there is a danger that the piston will hit very hard the upper face 204A of the lower body 204. To prevent this possibility, in the embodiment illustrated in FIG. 10, a dampener 290 may be provided between the blocking element 260 and the lower body 204, to slow the piston. The dampener includes a material that is configured to stay as a unitary body inside the air lock device until the blocking element 260 is sheared. In one embodiment, the dampener may be a viscoelastic polymer. When the blocking element 260 is sheared, the dampener 290 is configured to break into multiple independent pieces and dissolve in the fluid 107, so that no solid debris is left inside the wellbore.

For example, the dampener 290 may be made of compressed sugar or flour. As the top surface flowers open, the fluid pressure above the air lock device and the potentially violent action of the piston shatters and the fluid then dissolves the dampener. Another purpose of the dampener is to prevent the top surface of the blocking element from shredding into pieces and becoming debris. The broken bits of the dampener 290 are carried with the fluid for thousands of feet toward the toe of the well. This journey will provide enough time and disturbance to completely dissolve the dampener by the time it reaches the float collar. In another application, the dampener may include one or more of salt, ammonium nitrate, or other dissolvable materials. In one application, reactive elements could be used. Debris producing elements could also be used for the dampener material if they are mechanically very weak (clay) and do not damage nor clog other equipment in the well.

Figure 11:
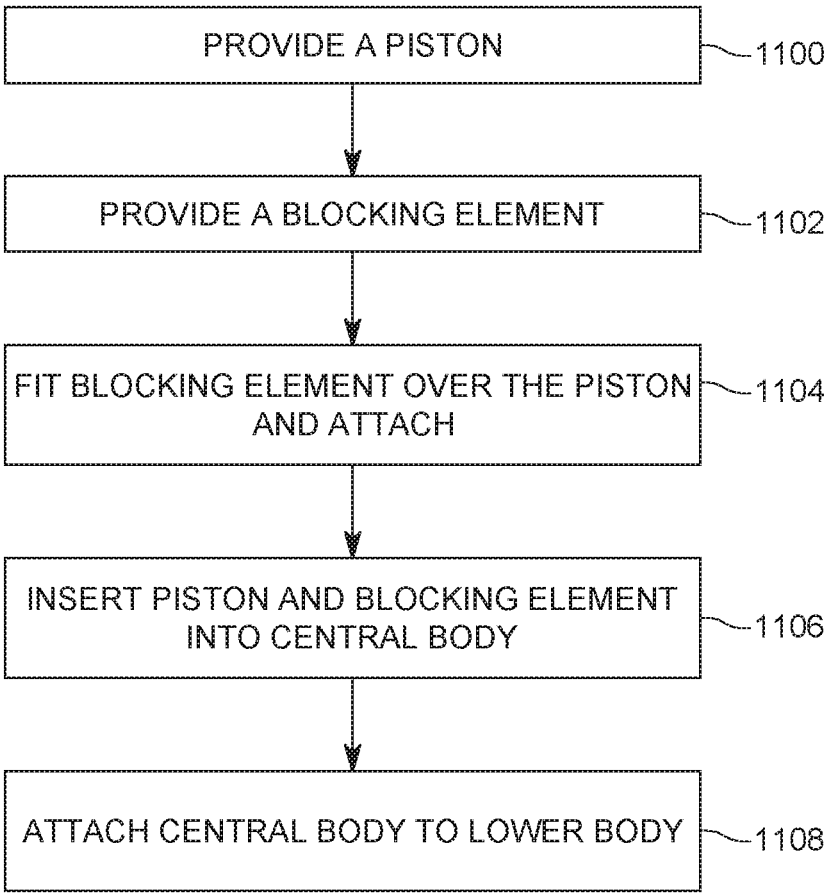
FIG. 11 is a flowchart of a method for assembling the air lock device.

A method for assembling the air lock device 200 is now discussed with regard to FIG. 11. In step 1100, a piston 230 is provided. The piston 230 has one or more holes 244 or, if the holes are not present, the holes are made into a lower end of the piston. The piston 230 also has a cutting element 246 formed into the lower end for cutting a blocking element. In step 1102, the blocking element 260 is provided. The blocking element 260 has a shoulder 262 into which plural holes 264 are formed. Attached to the shoulder 262 is a top surface 266, which can be cut into multiple parts while remaining attached to the shoulder.

In step 1104, the blocking element 260 is attached with shear pins 270 to the lower end of the piston 230. The shear pins 270 are inserted into the plural holes 264 of the blocking element 260 and into the plural holes 244 of the lower end of the piston 230. The shoulder 262 of the blocking element 260 is configured to have an inside diameter larger than an outside diameter of the cutting element 246 of the piston 230 so that the shoulder 262 fits over the cutting element 246. In step 1106, the assembly piston-blocking element is inserted into the central body 220 of the air lock element 200 and in step 1108 the lower body 204 is attached to the central body 220 so that the piston and the blocking element are confined inside the central body.

Figure 12:
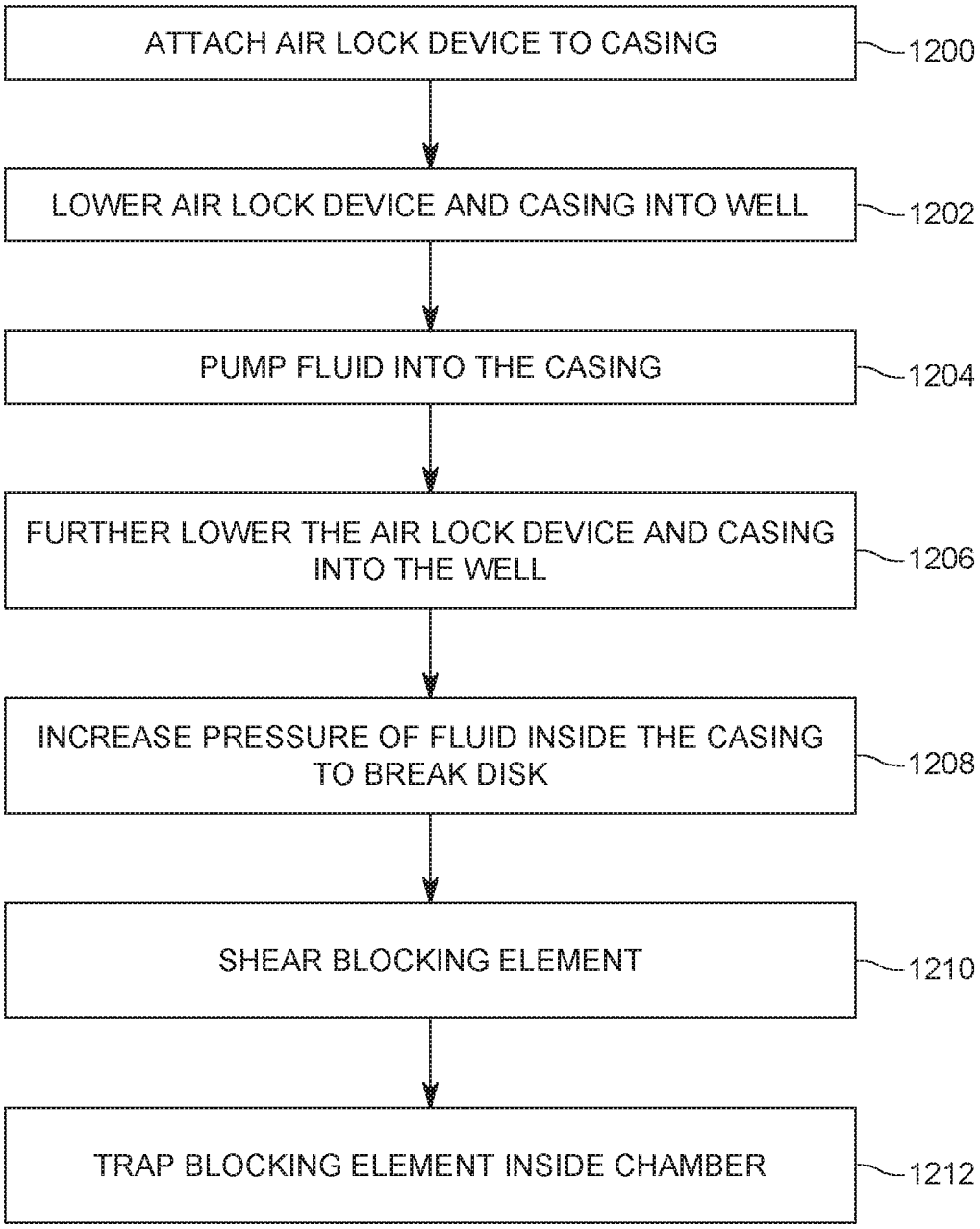
FIG. 12 is a flowchart of a method for actuating the air lock device to establish fluid communication between an upper part and a lower part of the casing.

A method for using the air lock device 200 is now discussed with regard to FIG. 12. In step 1200, the air lock device 200 is attached to a casing 250. Then, in step 1202, the air lock device 200 and the casing 250 are lowered into a well. In step 1204, a fluid is pumped into the casing, from a well head and the fluid accumulates above the air lock device 200 to help further push the casing into the well. No fluid is allowed by the air lock device 200 to pass into the lower part of the casing. In this way, the air that is inside the lower part of the casing provides buoyancy to the casing, reducing the friction between the exterior surface of the casing and the well. In step 1206, the casing and the air lock device are further pushed into the well so that the air lock device 200 is finally positioned in a vicinity of a heel of the well. At this time, the pressure of the fluid inside the casing is increased in step 1208 over a rating pressure of a bust disk 240 so that the burst disk 240 breaks.

When the disk 240 breaks, the pressure inside the casing starts to act on the piston 230 along the longitudinal direction and breaks the shear pins 270, thus releasing the piston and allowing the cutting element 246 to shear in step 1210 the blocking element 260. Alternatively, the dome may be manufactured to break open due solely to the increased pressure inside the casing. In one application, the dome is manufactured to remain as a single piece after being opened. In step 1212, the piston moves to a new position and traps the various portions of the sheared blocking element 260 inside a chamber 222, thus minimizing the possibility that debris from the blocking element would be traveling freely through the bore of the casing. At this time, fluid communication through the air lock device is established between the upper and lower parts of the casing.

The disclosed embodiments provide methods and systems for providing an air lock device that can be opened without generating a significant amount of debris inside a casing. It should be understood that this description is not intended to limit the invention. On the contrary, the embodiments are intended to cover alternatives, modifications and equivalents, which are included in the spirit and scope of the invention as defined by the appended claims. Further, in the detailed description of the embodiments, numerous specific details are set forth in order to provide a comprehensive understanding of the claimed invention. However, one skilled in the art would understand that various embodiments may be practiced without such specific details.

Although the features and elements of the present embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. An air lock device for sealing a casing located inside a well, the air lock device comprising:

a body having a bore and configured to be attached with each end to the casing;

a moving element located inside the bore, the moving element having a shoulder that extends radially toward the body and contacts the body, the shoulder divides the moving element into an upper part and a lower part, and the shoulder and the lower part of the moving element define an inner chamber with a wall of the body;

a burst disk located between the upper part of the moving element and the wall of the body; and a blocking element connected to the moving element, the blocking element preventing a fluid to pass through the bore of the body, wherein the shoulder of the moving element is fluidly separated from the bore by the burst disk, and wherein the inner chamber is sized to trap the blocking element after the blocking element is punctured by the moving element.

2. The air lock device of claim 1, wherein the burst disk is configured to close a passage between the bore and the shoulder of the moving element.

3. The air lock device of claim 2, wherein the upper part of the moving element, which extends between an upper end of the moving element and the shoulder, is in direct contact with an inner surface of the body.

4. The air lock device of claim 1, wherein the upper part of the moving element has a hole that fluidly communicates with the burst disk.

5. The air lock device of claim 1, wherein the moving element comprises:

a cutting element provided at a lower end of the moving element, wherein the cutting element is configured to shear the blocking element.

6. The air lock device of claim 1, further comprising:

shear pins that attach the blocking element to the moving element so that an upper end of the blocking element fits over a lower end of the moving element.

7. The air lock device of claim 1, wherein the blocking element comprises:

a shoulder and a top surface connected to the shoulder of the blocking element.

8. The air lock device of claim 7, wherein the body has a shoulder that mates with the shoulder of the blocking element and prevents the blocking element from sliding along the body.

9. The air lock device of claim 7, wherein the top surface has a groove that matches a position of a cutting element on the moving element.

10. The air lock device of claim 1, wherein the blocking element is made of a shearable material that does not break into independent parts.

11. The air lock device of claim 1, wherein the body includes a lower body that has an upper surface configured to stop a movement of the moving element.

12. The air lock device of claim 11, further comprising:

a dampener located between the moving element and the lower body, the dampener being in contact with the blocking element.

13. A method for opening an air lock device in a casing located in a well, the method comprising:

lowering the air lock device and the casing into the well, wherein the air lock device is inserted between an upper part and a lower part of the casing;

pumping a fluid into the upper part of the casing to further lower the casing into the well, wherein a blocking element located inside the air lock device prevents the fluid to pass through a bore of a body of the air lock device;

increasing a pressure in the upper part of the casing to break a burst disk located in the body of the air lock device, the burst disk covering a passage between the bore and a shoulder of a moving element located inside the air lock device, so that the fluid acts on the shoulder and moves the moving element;

puncturing the blocking element of the air lock device with the moving element; and trapping the sheared blocking element inside a chamber formed between the moving element and the body.

14. The method of claim 13, wherein the moving element includes a cutting element that shears open the blocking element.

15. The method of claim 13, further comprising:

breaking shear pins that attach the blocking element to the moving element.

16. The method of claim 13, further comprising:

engaging a shoulder of the blocking element with a shoulder of the body to prevent the blocking element from sliding along the body.

17. The method of claim 13, further comprising:

shearing the blocking element along a groove that matches a position of a cutting element of the moving element.

18. The method of claim 13, further comprising:

breaking into pieces a dampener located between the moving element and a lower body of the body, the dampener being in contact with the blocking element.

19. The method of claim 18, further comprising:

dissolving the dampener with the fluid in the well.

20. The method of claim 13, wherein the blocking element opens up due to the increased pressure inside the casing.

21. The method of claim 13, wherein the blocking element is opened up by the moving element and the entire ruptured blocking element is trapped between the moving element and the casing.

22. The method of claim 13, wherein the blocking element remains as one single piece after being opened.

* * * * *